US008261520B2

(12) United States Patent
Revheim et al.

(10) Patent No.: US 8,261,520 B2
(45) Date of Patent: Sep. 11, 2012

(54) SADDLE FOR RIDING OR CARRYING A LOAD

(75) Inventors: Sven Revheim, Hafrsfjord (NO); Azfor Ali, Ræge (NO)

(73) Assignee: Equine Fusion AS, Hafrsfjord (NO)

( * ) Notice: Subject to any disclaimer, the term of this patent is extended or adjusted under 35 U.S.C. 154(b) by 470 days.

(21) Appl. No.: 12/310,678

(22) PCT Filed: Sep. 5, 2007

(86) PCT No.: PCT/NO2007/000311

§ 371 (c)(1),
(2), (4) Date: Jul. 1, 2009

(87) PCT Pub. No.: WO2008/030103

PCT Pub. Date: Mar. 13, 2008

(65) Prior Publication Data

US 2009/0320419 A1 Dec. 31, 2009

(30) Foreign Application Priority Data

Sep. 5, 2006 (NO) ..... 20063965

(51) Int. Cl.
*B68C 1/04* (2006.01)

(52) U.S. Cl. ..... 54/44.3

(58) Field of Classification Search ..... 54/44.3, 54/44.1

See application file for complete search history.

(56) References Cited

U.S. PATENT DOCUMENTS

| | | | | |
|---|---|---|---|---|
| 2,353,622 | A | 7/1944 | Boyle | |
| 5,274,986 | A | 1/1994 | Gonzales | |
| 5,383,328 | A | 1/1995 | Brown | |
| 6,434,915 | B1 | 8/2002 | DeCosemo | |
| 6,523,332 | B1 * | 2/2003 | Erb | 54/44.5 |
| 6,688,087 | B2 * | 2/2004 | DeCosemo | 54/44.1 |
| 2004/0182051 | A1 * | 9/2004 | Walker | 54/44.3 |
| 2006/0168918 | A1 * | 8/2006 | Naslund et al. | 54/44.1 |
| 2010/0229507 | A1 * | 9/2010 | Strauss et al. | 54/44.3 |

FOREIGN PATENT DOCUMENTS

| | | |
|---|---|---|
| EP | 1 647 521 | 4/2006 |
| WO | 92/12094 | 7/1992 |
| WO | 2006/083174 | 8/2006 |

OTHER PUBLICATIONS

International Search Report mailed Jan. 10, 2008 for International Application No. PCT/N02007/000311.

* cited by examiner

*Primary Examiner* — Kristen C Hayes
(74) *Attorney, Agent, or Firm* — Wenderoth, Lind & Ponack, L.L.P.

(57) ABSTRACT

The present invention relates to a saddle for riding or carrying other load. The saddle includes at least two segments forming a frame, wherein, between the segments and between the right and left hand sides of each segment, flexible segment links allowing for relative movement thereof are provided, with the size, shape, flexibility, and stiffness of each segment being adapted to achieve an optimal weight distribution and freedom of movement, the segments and segment links or hinge elements are configured to allow for a relative independent movement thereof.

18 Claims, 7 Drawing Sheets

SADDLE FOR RIDING OR CARRYING A LOAD

BACKGROUND OF THE INVENTION

I. Technical Field

The present invention relates to a saddle arrangement for riding or carrying other loads.

The primary function of a saddle has been to stabilize and to make it more comfortable for a rider to sit on the back of an animal. Today, many horses are withdrawn from riding due to irritations and incurable back injury caused by saddle use. Typically, a saddle forms a padded seat comprising a firm frame, or saddle tree, which is strapped around the back of the animal. The saddle most commonly used today is the English type wherein the saddle is built around a frame referred to as a saddle tree, which is made of wood, steel, or a similar material. The saddle may be internally padded with wool or a synthetic fabric.

II. Description of the Related Art

Recently, there has been an increasing focus on the use of saddles and impact thereof on animals, and a number of studies have been conducted to investigate the effect of the saddle on the animal as the saddle is the one equipment that has the most impact on the comfort of animals when used for riding. These studies have shown that animals may develop unnatural movement patterns and suffer severe injuries in the form of muscular impairment and escape, inter alia, and also experience pain during and after riding caused by the use of saddles. Additionally, the animal may loose its flexibility and suppleness in the back and in other limbs. The blood supply of the muscles and the muscle movements are highly restrained by the saddle, being a static constriction across the back (FIG. 5). This is particularly impairing if the saddle does not fit the animal perfectly, so that the weight is distributed over a smaller area and applies point pressure. This may cause the back of the animal to deform and result in unnatural movements as a direct consequence of the saddle use. This could lead to permanent injury that also affects other parts of the body, and may among other things cause lameness, The back of a quadruped animal is comprised of elastic and rigid parts, the vertebral column, a long series of rigid segments supported by neighboring muscles and tissue to achieve stability and freedom of movement. The elastic parts of a back require extensive muscular control, and for an animal used for riding, it is the muscles that are the most vulnerable and exposed to injury. The back of an animal is not naturally built for carrying weight. In fact, the back of a horse is poorly adapted for carrying weight as this region doesn't have the same layers of fat as other parts of the body, causing the load to cause strain directly on the muscles extending across the back of the animal. The muscles of the animal must be continuously be supplied with energy in order to function properly, this being achieved by the transport of oxygen and nourishment through the blood circulation. When increasing the blood circulation of the muscles, the muscles will grow and the back of the animal will become stronger and have more carrying capacity. A muscle needs to stretch and retract, which is important in order for the muscle to resist the stress. One of the biggest problems for animals used in riding, is that it is a large static pressure or stress is applied in the muscles in movement and acting underneath the saddle. The static stress in the muscle may reduce the blood supply therein, causing pain and possibly muscle atrophy. Studies have shown that a surface pressure of more than 1.5 PSI for more than 2 hours renders the heart unable to pump a sufficient amount of blood through the muscles exposed, causing cells in these regions to die. This results in swells, bruises, and tenderness in the exposed regions. These problems aggravate if the saddle doesn't fit the animal properly, so that the weight of the rider is concentrated at very small areas. Additionally, a rigid saddle will impair the natural movements of the animal, with the result being that the animal strenuously and in an unnatural manner tries to adapt to the saddle, loosing its original flexibility and natural movement pattern. The fit across the shoulders of the horse is the most important, as the movements of this region are large; in this region the injuries caused by the current saddle designs is seen in that the saddle is adapted, after which the animal changes shape or muscles and the saddle becomes too constricting and adds a large pressure on the shoulders to cause point stresses. By having an easy to use width adjustment means that can be accessed and adjusted each time the animal is to be used, the use of a too constricting saddle can be avoided and the saddle may also be safely used on different horses so that it is not necessary to buy a new saddle for each horse and to buy a new saddle should the horse change shape through a change of weight and/or musculature. The saddle is supposed to distribute the weight of the rider over the greatest area possible without breaking with anatomical fitting rules for a well-conforming saddle. This relates to how well the saddle fits the animal and how large a surface that is seated in the saddle. Further, the fit across the shoulders is essential for the conformity of the saddle, in particular with respect to comfort and the prevention of injuries.

The natural movements of the animal will always be affected by the application of unnatural pressure or constrictions on the anatomical function of the animal, and the goal is to interfere with the natural movements of the animal to the smallest extent possible. For the rider it is important that the animal maintains a natural movement pattern, so as to have a healthy animal with good movements. The animal then has more load carrying ability and is less exposed to injuries/pain that makes the movements unnatural, rigid, and less comfortable for the rider.

In principle, the saddle must be adapted to accommodate the animal and the buttocks of the rider, putting very differing demands on the shape, conformity and function. The main problem is that the back of the animal is moving while at the same the rider must have sufficient stability in the saddle.

Saddle fitting is a difficult task, as it requires a lot of work to have the saddle modified. A lot of time, tools and additional parts are required, or a completely new saddle may be adapted, which is costly in any case. The current methods for modifying the saddle width usually are based on standard sizes, including particular size levels such as small, medium, large, etc., which may be a problem in the case of an animal that falls outside these levels or the animal has a dip, muscular atrophy, or otherwise changed shape. The horse may change its body shape rapidly due to changes in musculature through growth, exercise, change of diet, or seasonal variations. Therefore, a well conforming saddle is difficult to achieve with the current saddles. Additionally, the current saddles are not favorable with respect to being used with several animals. The saddle fit is such an important aspect of the comfort of the animal that the saddle should be able to be accurately adjusted and adapted to each single individual. The animal may suffer a dip at the shoulders if the saddle is constricting or applies pressure, which causes great pain and may permanently deform the animal. There is a great variability and individuality in the shoulder anatomy between different animals, with some individuals being very wide in the shoulder region whereas others may have a very slender shoulder region and still others may ha a dip caused by an injury due to the careless use of saddle. This is a reason why it is advised against using the same saddle on different animals. However, the fact still remains that an animal often "inherits" a saddle, or that a saddle is "borrowed" from another animal. Therefore, it may be concluded that a conventional saddle never really will be optimal, even not for the animal to which the saddle was originally fit.

A quadruped animal has a spine consisting of a column of dorsal vertebrae. In the saddle area of a horse, about 18 vertebrae will be located underneath the saddle. Each vertebra has its degree of flexibility. A horse has a total of 56 vertebrae having a varying degree of flexibility and freedom of movement.

When a horse moves, the vertebra will move relative to each other to form complicated movement patterns that a conventional saddle is not able to follow or accommodate. A horse makes muscular movements that are different on each side of the spine, and these are essential for the biomechanical functionality and atletism of the animal. As the saddle tree is the most essential part of a saddle, if the saddle tree does not fit the back of the horse, then the saddle doesn't fit either. A saddle tree is supposed to conform to the horse when the horse is moving, and it is supposed to position the rider correctly on the horse. FIGS. 5 and 6 show a hest bending sideways from the longitudinal direction. When the horse bends as shown in FIGS. 5 and 6, a conventional rigid saddle tree will restrict the natural bending movement of the horse as the conventional saddle tree doesn't accommodate the bending movement.

FIG. 2 shows how the back bow of a horse may look. The shoulder region is raised and leads down to a lower point between dorsal vertebrae 14 and 18, after which the back bow runs upwardly towards the hind region of the horse. The three back regions of the horse have very differing shapes, functions, and muscular structures. Different paces and movement patterns result in separate and unsynchronized movements of the different back regions.

A conventional rigid saddle tree is not shaped in accommodation to each individual part of the functions and movement patterns of the back regions. Thus, at some point the saddle tree will place restrictions and apply pressure to the movement and back of the animal, see FIG. 5. Also, a conventional saddle tree doesn't position the rider in an optimal position relative to the back bow of the horse. A rigid conventional saddle tree will cause undesirable points of pressure application on the back of the horse. This is often compensated by means of gel or other materials in an attempt to modify the shape of the conventional saddle tree.

The U.S. Pat. No. 2,353,622 shows a saddle design wherein an attempt has been made to make the saddle flexible by fitting two additional parts to a conventional saddle by means of ball joints. Said two parts are connected by the use of flexible straps or belts on each side of the backbone of the horse. However, the saddle design according to U.S. Pat. No. 2,353,622 causes undesirable points of contact because it includes a conventional rigid saddle tree. As a consequence, the saddle fails to follow the movements of the animal and hence restricts the movement pattern of the horse. Moreover, this saddle design may also cause injury to the horse in that the saddle has to be correctly fit in order to function properly. Furthermore, the saddle tree according to U.S. Pat. No. 2,353,622 has no means of width adjustment pursuant to changes in shape and muscular structure of the animal and may not be adapted for other animals. If the saddle tree of U.S. Pat. No. 2,353,622 is not wide enough to fit across the back of the horse, this saddle will inflict the same injury to the animal as the ones described above. Also, the saddle design according to U.S. Pat. No. 2,353,622 adds more height than desirable as the saddle tree is not modified directly, but instead additional parts are added in order to make the saddle tree more movable. Additional parts and complex mechanisms also add to the manufacturing cost of the product.

U.S. Pat. No. 5,274,986 discloses re-padding of an essentially conventional rigid saddle tree. This saddle tree includes no means of adaptation and needs to have a certain thickness in order to not bend under the weight of the rider, increasing the stiffness of the saddle tree. According to U.S. Pat. No. 5,274,986, the saddle tree is designed for being able to conform to the contour and movement of the animal, but if the saddle tree is already too constricting, additional padding will just make the saddle even more constricting. Additionally, compensating with additional padding will increase the weight and height of the saddle. The rider is positioned further away from the horse than necessary. Also, additional padding is conducive to the generation of heat underneath the saddle, which is uncomfortable and also causes the formation of girth galls. Additional parts and padding also add to the manufacturing cost of the product.

U.S. Pat. No. 6,434,915 relates to a saddle having no saddle tree, wherein the saddle is made of soft materials such as foam rubber and flexible leather to make the saddle fit. The disadvantage of having a saddle with no saddle tree is that it is necessary to compensate for the missing saddle tree with a lot of additional padding, causing the rider to be seated higher up and further forward on the animal than desired and also an extensive generation of heat underneath the saddle which is not conducted away. With all material being compliant, a maximum pressure relief and pressure distribution is not achieved and the construction becomes lumped. Such a treeless saddle may not be used for show-jumping due to the insufficient pressure relief and inadequate support for the rider, but may only be used for easy tour riding.

As mentioned above, conventional saddle trees have primarily been constructed with a rigid structure. It has been attempted to adjust the rigid structure by the use of gel inserts and similar padding materials to make the saddle conform to the shape and movement of the horseback after an injury has been detected in the back of a horse that has been ridden with a conventional saddle tree. Attempts have been made to make the saddle tree more flexible and movable by using different materials such as spun glass and the like and by adding additional moveable parts underneath the saddle tree. Attempts have also been made to dispose of the entire rigid saddle tree. So far, nobody has addressed the saddle tree itself to make changes thereof to make it movable and adaptable, making it conform to the shape of the animal each time the saddle is to be used and accommodate all the natural movements of the horse.

SUMMARY OF THE INVENTION

The object of the invention is to provide a saddle that does not suffer from the above drawbacks.

The above objects are achieved by a saddle that is characterized in the features set forth in the characterizing part of the independent claims. Further advantageous features and embodiments are set forth in the dependent claims.

BRIEF DESCRIPTION OF THE DRAWINGS

In the following, a detailed description of the present invention is given with reference to the accompanying drawings, in which.

DETAILED DESCRIPTION OF THE INVENTION

The present invention relates to a saddle 1, the primary purpose of which is to be able to be adapted to an individual animal due to a change of shape, for example, saddle 1 being configured so as to follow the movements of the animal and not constrict the natural movement pattern thereof. Additionally, saddle 1 according to the present invention is configured so that the stress put on the horseback is distributed in the best manner possible. This is achieved, inter alia, in that saddle 1 includes at least three segments 2, 3, 4 forming a frame wherein the segments are designed to fit the individual details of the back of the animal, and in that the width of the saddle is easily adjustable.

Figure 8:
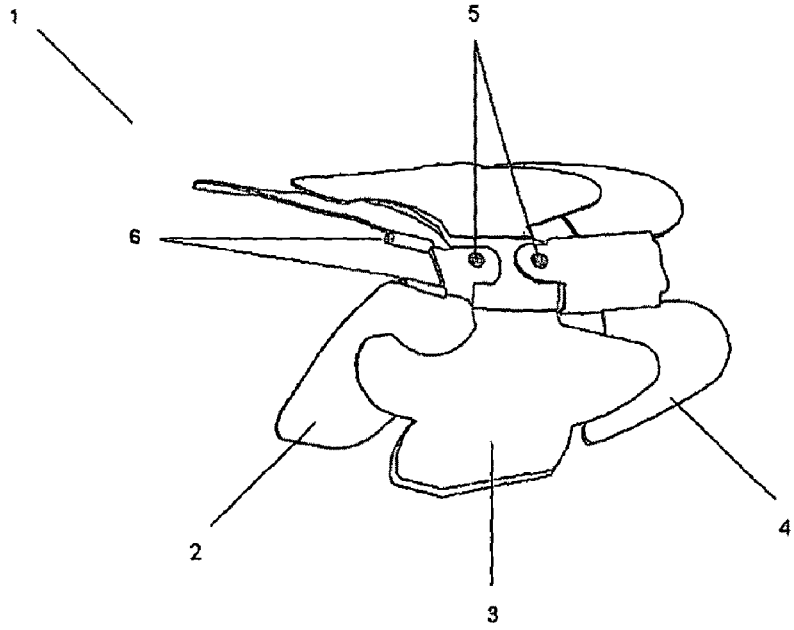
FIG. 8 shows a saddle according to the present invention that follows the movements of the animal.

Segments 2, 3, 4 are comprised of at least three joined elements as shown in FIG. 8. Together, segments 2, 3, 4 form a continuous surface distributing the weight of the rider. Each segment 2, 3, 4 is anatomically shaped depending on its intended position on the animal, with segments 2, 3, 4 being shaped so as to provide the best possible fit to the different details of shape along the back of the animal. Additionally, the rider will be seated correctly as the lower point of the saddle, as that of the horse, is then located the centre of the saddle so that the rider will automatically be positioned correctly relative to the particular animal with which the saddle is used. Splitting up the saddle according to these three different anatomical shapes and functions is a completely new idea of how to design a saddle. This way of conforming to the shape and function will give the rider a better feel of the movements of the horse and add a new aspect to the riding experience by not distancing the movement between the horse and rider. In addition, the saddle will ensure a more natural adaptation to the individual, with other constructions being large, rigid saddles positioned on a soft contoured back.

A horse has 18 dorsal vertebrae within the area covered by the saddle, and each vertebra transition allows a movement of about 4 degrees. A horse has a total of 56 vertebrae having a varying degree of flexibility, giving the animal an overall great degree of flexibility and mobility in the back. It is important that the rider is able to feel the movement of the horse, as this has great impact on the performance of the animal in exercise, and that the animal uses its back correctly. For example, it is important that the animal "rounds" the back and does not sway it under the rider. In order to have the animal do so, it is important that the animal is able to do it with the least possible pressure and point stress as well as resistance making it uncomfortable to raise/round the back properly. When the horse is trotting in a natural manner without carrying a rider, the middle part of the back will move up and down twice in each step taken by the animal. The back rounds when the animal is in the step and sways slightly down when the diagonal legs carries the weight. Joints in the rear part of the back swing in time with the step, being maximally rounded when the rear leg is stretched forwardly and flattening slightly when the leg is pushed backwards. This is also the case when the saddle is positioned on the back, with the rider thereon. In order for the back to function more optimally when the animal is carrying a rider, the saddle needs to have a certain degree of vertical flexibility so as to accommodate this movement of the animal without encountering a hard surface and extensive resistance to this natural movement in the step. That is, the saddle must be compliant to these movements, which may easily be overlooked by the rider, but nonetheless are important for the bio mechanism and ability of the animal to carry out proper and unrestricted movements.

Figure 1:
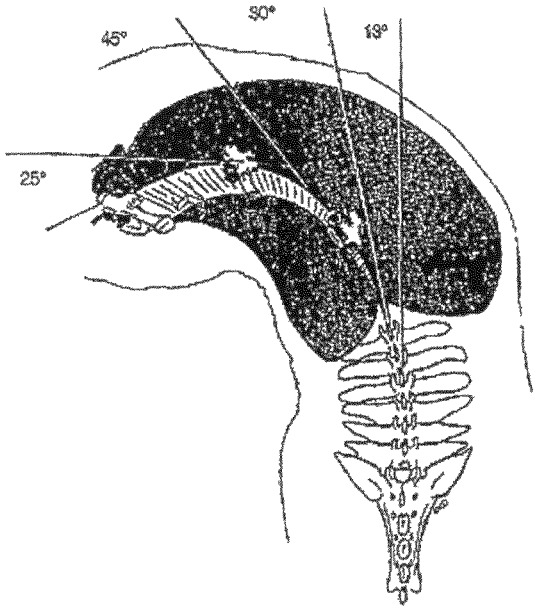
FIG. 1 shows the degree of mobility and flexibility of the vertebral column of a hest.
Figure 2:
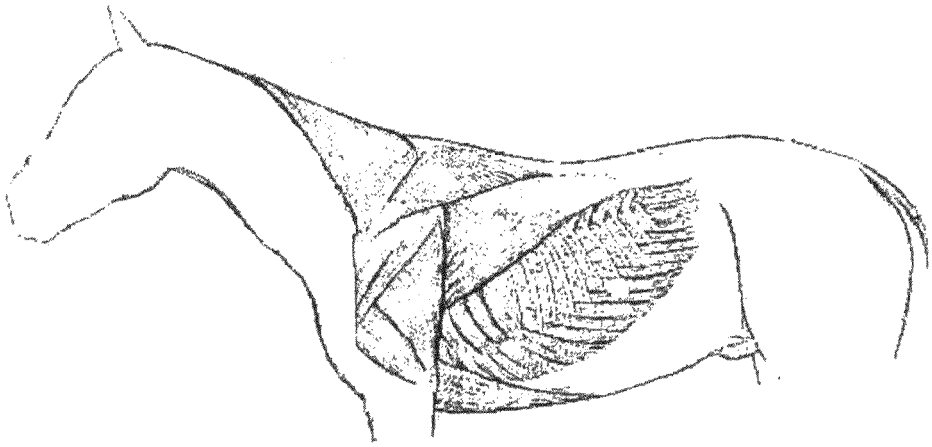
FIG. 2 shows the superficial muscular system of a horse.
Figure 3:
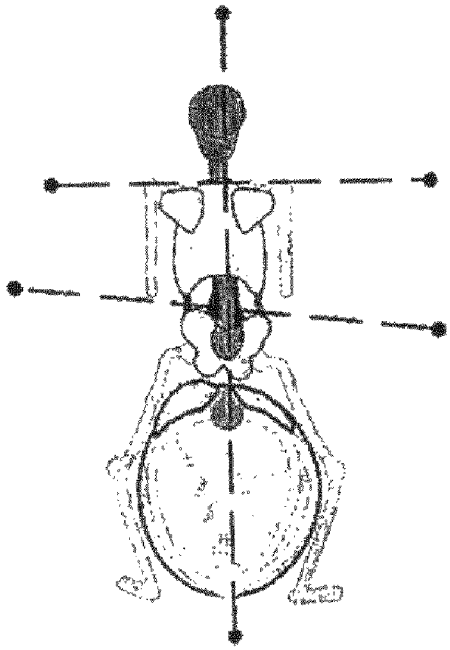
FIG. 3 shows the independent muscular movements of a horse on each side of the backbone acting under the saddle and rider.
Figure 4:
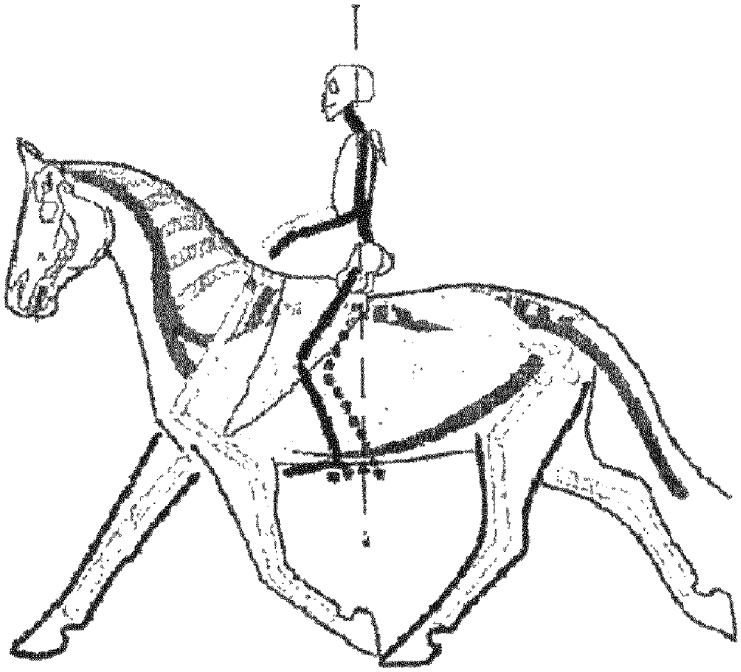
FIG. 4 shows the superficial muscles acting under the saddle and rider.
Figure 5:
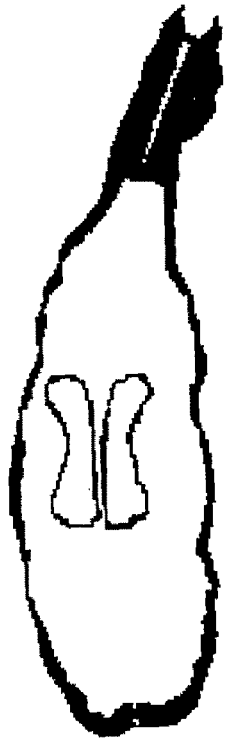
FIG. 5 shows a saddle design using a traditional saddle tree, wherein the saddle does not follow the movements of the animal when the back is bent.
Figure 6:
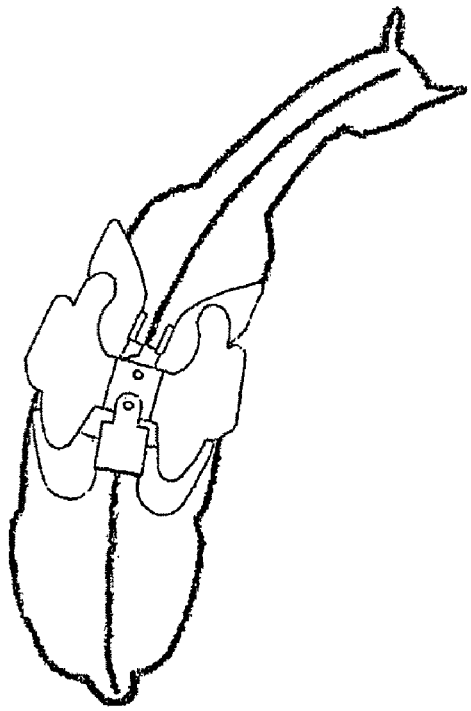
FIG. 6 shows an embodiment of a saddle according to the present invention, wherein the saddle follows the movements of the animal when bending the back and provides a larger contact surface of weight distribution.
Figure 7:
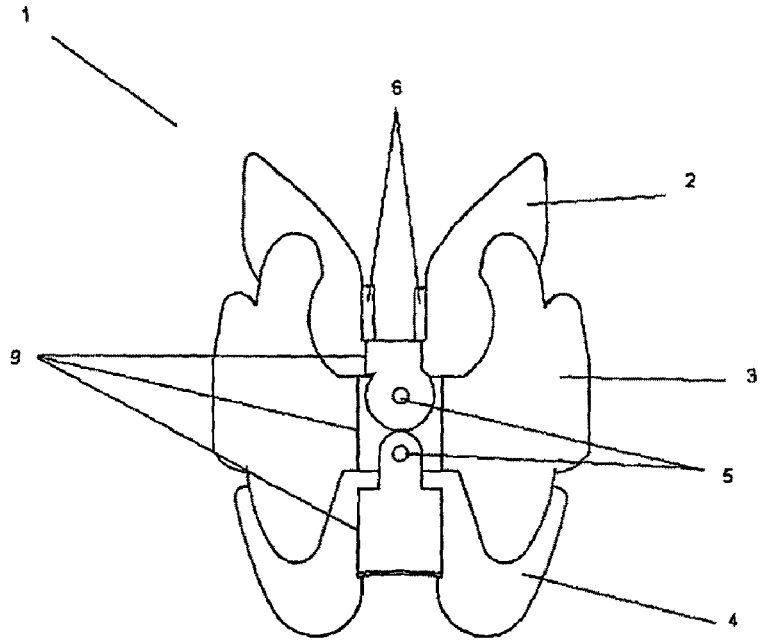
FIG. 7 shows an adjustment lock for adapting a saddle according to the present invention, wherein the lock may be used for widening or narrowing the saddle width.

Saddle 1 is configured for being able to bend in any direction, so that the saddle is able to adapt to the shape and movements of the animal in all directions, see FIG. 6. Segments 2, 3, 4 are designed for being able to conform to coincident and non-coincident movements on the right hand side as well as the left hand side of the back of the animal due to the muscular movements. This is achieved in that segments 2, 3, 4 of saddle 1 include either flexible segment links that mechanically by means of a force/energy or chemically locks the segments together, or a combination thereof, which, in operation, provides suitable connection mechanisms between segments 2, 3, 4, such as hinge elements 5, allowing freedom of movement. By allowing segments 2, 3, 4 to move relative to each other and thus follow the movement of the horse's back, the blood circulation in the back of the animal will improve greatly as the saddle will not apply any static pressure to the muscles, see FIG. 5, but rather conform to the muscular movements of the animal, see FIG. 6. Saddle 1 will also follow the movements of the animal when it is galloping, for example, in which case the animal bends its back slightly in the jump so that the back rises in the step. This is also the case for show-jumping wherein the back of the animal bends inwards and outwards.

In the design of the saddle 1 according to the present invention, it is a main objective to constrict the natural movement pattern of the animal to the smallest extent possible. This is achieved by conforming to the animals own back anatomy, consisting of flexible, elastic and rigid parts to enable movement and achieve stability at the same time. Built on this principle, the invention lies in that the saddle 1 includes two or more segments that are assembled in such a manner that they follow the movements of the animal while at the same time providing stability and a continuous surface against the back of the animal to ensure the best possible weight distribution in movement, see FIGS. 5, 6.

It is to be understood that saddle 1 may include more than three segments 2, 3, 4; any number of segments may be used. Each segment 2, 3, 4 includes a right side and a left side part. It is understood that the right side and left side parts of each segment 2, 3, 4 may move independently of each other, in particular in a vertical direction. This is achieved by means of the above flexible segment links comprised by segments 2, 3, 4 that mechanically by means of a force/energy or chemically locks the segments together, or a combination thereof, which, in operation, provides suitable connection mechanisms between segments 2, 3, 4, such as hinge elements 5. It is further understood that each segment 2, 3, 4 has a shape, rigidity, and flexibility that optimizes the weight distribution and movement. A segment should not be so flexible that the weight is not distributed properly, and at the same time the stiffness should not be so great that the movement of the animal is constricted. Segments 2, 3, 4 may have differing stiffness and flexibility relative to each other, with segments 2, 3, 4 having a certain degree of mutual overlap and being supposed to transfer and distribute loads. Each one of segments 2, 3, 4 may also include more or less flexible and/or rigid zones facilitating the optimization of the weight distribution and mobility.

Segments 2, 3, 4 of the present invention will increase the comfort of the animal as saddle 1 conforms to the movements thereof. The rider gets a better feel with the movements of the horse in that saddle 1 interferes as little as possible with the natural movement of the horse.

Segments 2, 3, 4 of saddle 1 are designed to be easily adjustable to the strongly varying shoulder area, for example, which is of vital importance for the adaptation. For example, the foremost segment 2 may include a mechanical adjustment mechanism 6 that helps allowing an easy narrowing or widening of the foremost part of saddle 1, with the following segments 3, 4 to a certain extent following the width adjustment of the foremost segment 2 as being flexible on each side of the backbone of the animal. Saddle 1 is individually steplessly adjustable to the shoulder width of the animal, which adjustment can be carried out by the rider if the animal changes shape or the saddle is to be fit to another animal. Alternatively, each segment may include an adjustment mechanism 6 that helps allowing an easy narrowing or widening of the size of saddle 1. It shall be possible to use the saddle 1 with animals of different size by adapting the saddle 1 to the animal using a mechanism with which the rider may narrow or widen the saddle to a size fitting the animal. This may be carried out by the rider when sitting in the saddle. This is accomplished without the use of any tool, additional parts, or the application of external influence such as temperature, etc. Segments 2, 3, 4, which by means of a force/energy or chemically lock the segments together, or a combination thereof, which, in operation, provides suitable connections means between segments 2, 3, 4, such as hinge elements 5. Segments 2, 3, 4, seat 7, stirrups 8, etc., may be connected by suitable connector mechanisms, that mechanically by means of a force/energy or chemically, for example, lock the segments together, or a combination thereof, which, in operation provides suitable connection means or glue such as glue-based flexible silicone, composites, buckles, velcros, button connections, threaded connections, etc. This will provide a saddle 1 that will always fit the animal. Saddle 1 of the present invention is constructed according to general specifications relative to the anatomy and comfort for the animal so that the back of the animal is protected in the best possible manner in that saddle 1 may easily be adapted for a particular individual without imposing any restriction across the shoulder area of the animal.

Figure 9:
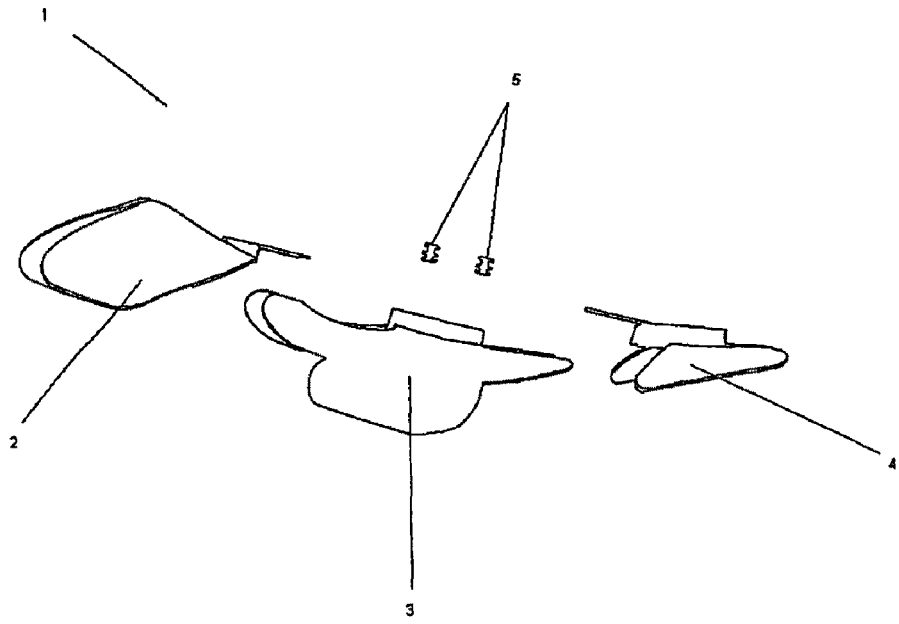
FIG. 9 shows an embodiment of the present invention comprising modules that may easily be put on and removed in order to obtain the desired seat size, function, and area of use.
Figure 10:
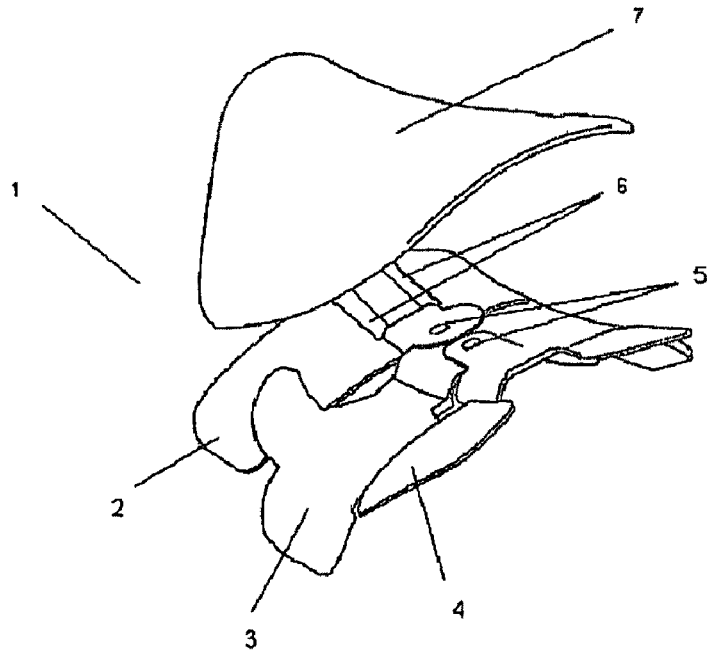
FIG. 10 shows a seat that attaches to segments according to the present invention.

Also, segments 2, 3, 4 may be replaced in order to accommodate adjustment and function in that saddle 1 is based on a modular, adaptable system and by adjustments of the modules themselves that the rider may rapidly modify in adaptation to the animal, rider, or intended use, or by replacing the individual modules, see FIG. 9. In order to fit saddle 1 to the rider, parts of a seat 7, or even the whole seat, may include modules that may be replaced with other modules in adaptation to the rider or intended use. The rider may easily adapt the saddle 1 to different types of exercise such as show-jumping, dressage, ordinary riding, etc., see FIG. 10. This applies to segments 2, 3, 4, as well as seat 7, which is attached to the segments. Modules may be changed in accommodation to the animal, rider, or intended use for providing an optimal fit. The seat may be adapted to the rider in that the seat modules may easily be attached to the segmented frame that is fit to the animal. This means that the saddle 1 is comprised of segments 2, 3, 4 that may be replaced in a modular manner in adaptation to a particular horse, the intended use, as well as the rider. This system will allow a great freedom of choice with respect to saddle adaptation and function, and make it easy to fit the saddle 1 to accommodate both the animal and rider.

Figure 11:
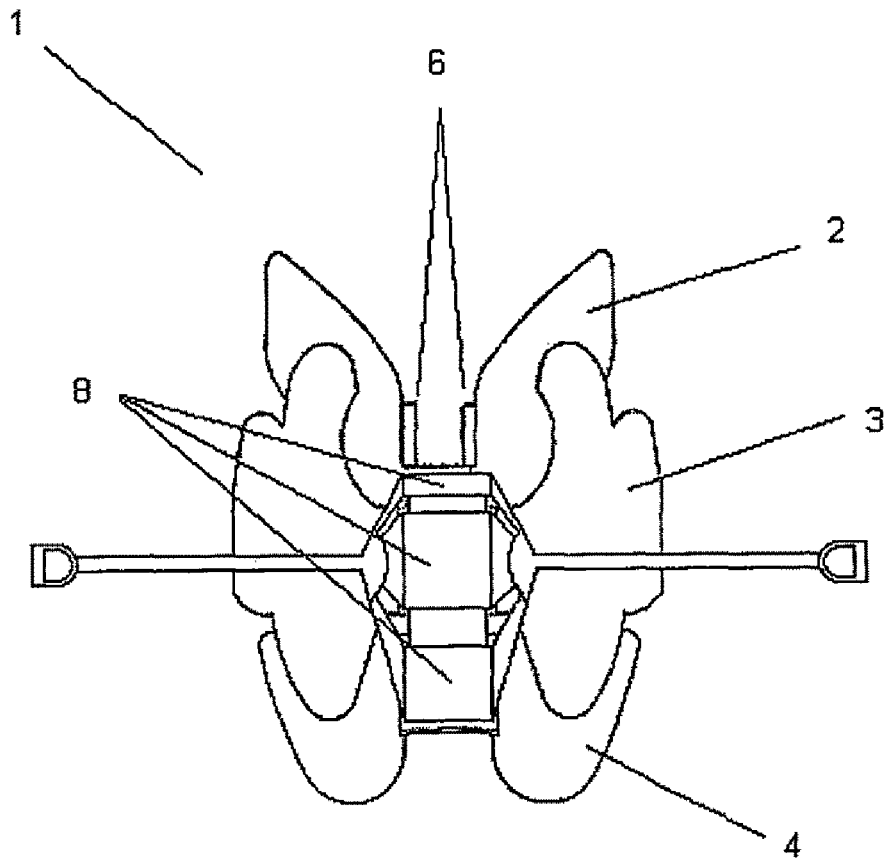
FIG. 11 shows the attachment of stirrups to each segment of the saddle according to the present invention.
Figure 12:
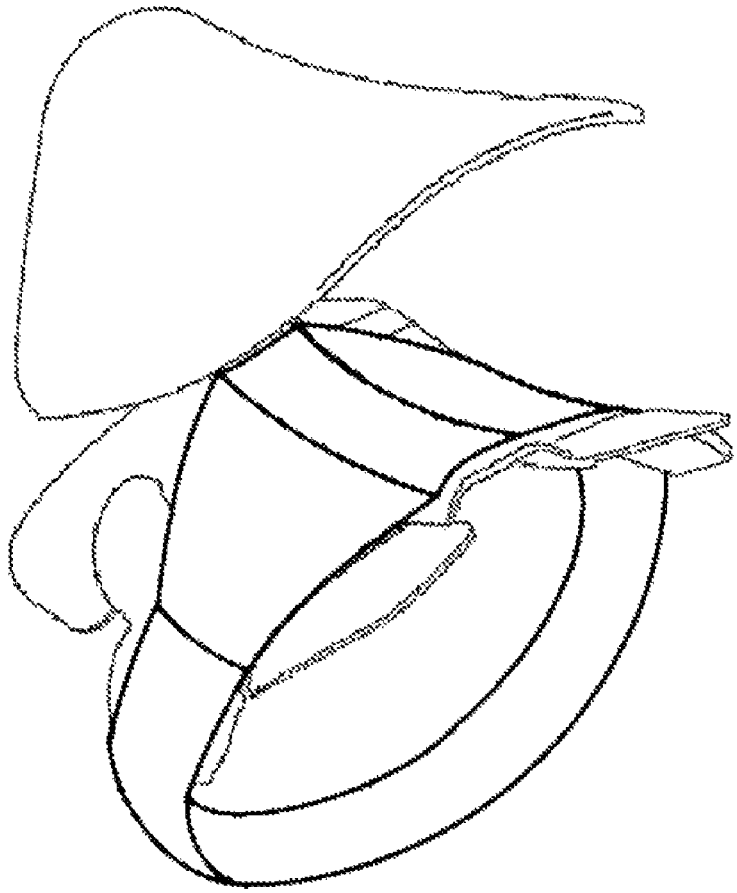
FIG. 12 shows a seat including the girth.

According to the present invention, stirrups 8 of saddle 1 will be mounted in such a manner that the weight of the rider is distributed to the largest area possible. This is achieved in that a stirrups attachment 9 is fixed to several or all of segments 2, 3, 4, see FIG. 11, so that the weight distribution when the rider is standing up will be the same as when the rider sits in the saddle 1. This arrangement will help stabilizing the saddle 1 and rider on the animal. Additionally, shocks and impacts will be absorbed and distributed in a better way as the weight of the rider is distributed evenly and as, through the proper choice of material, a shock-absorbing effect may be achieved in the stirrups. The stirrups attachment will follow the movements of the saddles as it is fixed to each one of several of the segments. As shown in FIG. 12, the saddle can include girth.

Segments 2, 3, 4 and the other modules forming saddle 1 may be made of plastic, carbon fibre, glass fibre, metal, wood, or any other suitable materials as well as combinations thereof. The saddle may be manufactured using essentially known, modern production methods and materials taking into consideration that the saddle shall be lightweight, flexible, comfortable, and also provide the best possible ventilation in order to avoid an excessive heat generation underneath the saddle. According to one embodiment, segments 2, 3, 4 may be individually form-cast to fit a particular horse, while at the same time the possibility that the shape of the horse may change in the course of time may be taken into account.

It is understood that the saddle 1 according to the present invention may be used with other kinds of animals than horses. Any animal that may be used for riding and/or carrying a load may advantageously use a saddle according to the principles of the present invention, such as donkeys, camels, elephants, etc. Further, the invention is not limited to riding, but may also be used in connection with a load-carrying system or even a harness system for pulling ploughs, trees, etc.

The invention claimed is:

1. A saddle for riding or carrying a load, comprising:

a saddle tree; and a seat or load-carrying structure arranged on top of said saddle tree, wherein said saddle tree comprises at least two segments connected to each other with moveable segment links or hinge elements, said moveable segment links or hinge elements enabling relative independent movement between said at least two segments, and said at least two segments being arranged on a right side and a left side of said saddle tree, respectively.

2. The saddle of claim 1, wherein each moveable segment link or hinge element of said moveable segment links or hinge elements is configured so as to be capable of moving in one or more directions, so that said at least two segments are capable of moving independently of each other in one or more directions.

3. The saddle of claim 2, wherein for at least one said at least two segments arranged on said right and left sides of said saddle tree, an adjustment mechanism is disposed and is configured to provide width adjustment of said saddle tree.

4. The saddle of claim 2, wherein each segment of said at least two segments includes different material properties in terms of flexibility from each of other moveable segment link or hinge element.

5. The saddle of claim 2, further comprising girth and stirrups.

6. The saddle of claim 1, wherein for at least one of said at least two segments arranged on said right and left sides of said saddle tree, an adjustment mechanism is disposed and is configured to provide width adjustment of said saddle tree.

7. The saddle of claim 6, wherein said adjustment mechanism is configured to adjust a distance between said right side and said left side of said saddle tree and is arranged to form part of said moveable segment links or hinge elements.

8. The saddle of claim 6, wherein each of said at least two segments, said seat or load-carrying structure, and said adjustment mechanism, are replaceable modules capable of changing the function, size, and area of application of said saddle.

9. The saddle of claim 6, wherein each segment of said at least two segments includes different material properties in terms of flexibility from each other segment of said at least two segments.

10. The saddle of claim 6, further comprising girth and stirrups.

11. The saddle of claim 7, wherein each segment of said at least two segments, said seat or load-carrying structure, and said adjustment mechanism, are replaceable modules capable of at least one of changing the function, size, and area of application of said saddle.

12. The saddle of claim 1, wherein each segment of said at least two segments includes different material properties in terms of flexibility from each other of said at least two segments.

13. The saddle of claim 12, further comprising girth and stirrups.

14. The saddle of claim 12, wherein each segment of said at least two segments, said seat or load-carrying structure, and said adjustment mechanism, are replaceable modules capable of changing the function, size, and area of application of said saddle.

15. The saddle of claim 1, further comprising girth and stirrups.

16. The saddle of claim 15, wherein said stirrups are fastened by a stirrups attachment that is fixed to said saddle tree formed by said at least two segments.

17. The saddle of claim 15, wherein each said segment of said at least two segments, said seat or load-carrying structure, and said adjustment mechanism, are replaceable modules capable of changing the function, size, and area of application of said saddle.

18. The saddle of claim 1, wherein said moveable segment links or hinge elements include a mechanical mechanism which, by a force, or glue, or a combination thereof, maintains a connection between said at least two segments.

* * * * *